US007223160B2

(12) United States Patent
Anderson

(10) Patent No.: US 7,223,160 B2
(45) Date of Patent: May 29, 2007

(54) SYSTEM FOR REPLACEMENT OF SHEET ABRASIVE

(75) Inventor: Thomas M. Anderson, Plymouth, MN (US)

(73) Assignee: Timesavers, Inc., Maple Grove, MN (US)

( * ) Notice: Subject to any disclaimer, the term of this patent is extended or adjusted under 35 U.S.C. 154(b) by 102 days.

(21) Appl. No.: 10/552,391

(22) PCT Filed: Apr. 8, 2004

(86) PCT No.: PCT/US2004/011054

§ 371 (c)(1),
(2), (4) Date: Oct. 7, 2005

(87) PCT Pub. No.: WO2004/091855

PCT Pub. Date: Oct. 28, 2004

(65) Prior Publication Data

US 2006/0189266 A1 Aug. 24, 2006

Related U.S. Application Data

(60) Provisional application No. 60/461,392, filed on Apr. 8, 2003.

(51) Int. Cl.
*B24B 41/00* (2006.01)

(52) U.S. Cl. ..... 451/296; 451/502

(58) Field of Classification Search ..... 451/296, 451/166–168, 163, 162, 159, 356, 357, 28, 451/490, 499, 502, 520, 522
See application file for complete search history.

(56) References Cited

U.S. PATENT DOCUMENTS

| | | | | |
|---|---|---|---|---|
| 932,879 | A * | 8/1909 | May | 451/502 |
| 1,656,981 | A * | 1/1928 | Lewis | 451/502 |
| 2,492,372 | A * | 12/1949 | Smith | 451/356 |
| 5,649,855 | A * | 7/1997 | Chikaki | 451/290 |
| 6,001,004 | A * | 12/1999 | Botteghi | 451/168 |
| 6,612,914 | B2 * | 9/2003 | Gurusamy et al. | 451/173 |

* cited by examiner

*Primary Examiner*—Robert A. Rose
(74) *Attorney, Agent, or Firm*—Gray, Plant, Mooty, Mooty & Bennett, PA; Peter Forrest

(57) ABSTRACT

A system for rapid replacement of abrasive in machinery which uses the abrasive to finish the surfaces of workpieces that pass through the machinery on a belt, such as so-called widebelt sanders. One preferred embodiment of the system employs an abrasive material that is frictionally held on each edge to mounts. The position of the mounts may be varied to increase or decrease the tension of abrasive material against the working surface of the platen, that the assembly may be removed from the apparatus. In another embodiment, the abrasive material is formed with integral, permanent mounts on the edges of the abrasive material, so that the entire combination may be supplied or replaced as a unit. A variety of configurations of mounts may be used.

42 Claims, 8 Drawing Sheets

SYSTEM FOR REPLACEMENT OF SHEET ABRASIVE

CROSS-REFERENCE TO RELATED APPLICATION

This application claims the benefit of provisional application No. 60/461,392 filed Apr. 8, 2003.

TECHNICAL FIELD

This invention relates to systems for rapid replacement of abrasive in machinery which uses the abrasive to finish the surfaces of workpieces that pass through the machinery on a belt, such as so-called widebelt sanders.

BACKGROUND

The basic features of surface finishing machines of the type that represent the preferred environment for the invention are shown in at least the following U.S. Patents, the entire contents of which are incorporated into reference, and a copy of which is enclosed as if fully set forth in the text of this document: U.S. Pat. No. 5,081,794 (Haney); U.S. Pat. No. 5,181,342 (Haney); U.S. Pat. No. 5,321,913 (Haney); U.S. Pat. No. 5,443,414 (Haney); U.S. Pat. No. 5,702,287 (Haney); U.S. Pat. No. 5,707,273 (Grivna); U.S. Pat. No. 4,473,500 (David); U.S. Pat. No. 4,837,984 (David); and U.S. Pat. No. 4,864,775 (David).

Such machines typically use a platen-mounted abrasive element that comprises an abrasive medium itself, e.g., sandpaper, emery cloth, or in general any thin paper-backed or fabric-backed sheet bearing a layer of finely sized abrasive particles, such as sand, ceramic, and the like. A resilient pad on the non-abrasive side of the abrasive material improves performance. Because of the forces created by very rapid motion required so the abrasive material does not leave scratches and other defects in the workpiece to be finished by the equipment, the supporting metal platen may itself be somewhat permanently mounted in the apparatus or not easily removable, depending on the configuration, so that it does not have a significant amount of mechanical play in its mounting subassembly. Thus, typically, replacement of the abrasive material requires removal and reconfiguration of any or all of the entire platen, the resilient material, and the abrasive material itself.

Thus, some means of removing the abrasive material (with or without the resilient pad accompanying it) must be provided so that the abrasive material may be changed as required. For example, as disclosed in FIGS. 5 and 6 and accompanying text of the Haney patents noted above, one approach is to secure an abrasive to the platen around a foam lying between the backside of the abrasive and the platen. Clips are used to secure the edges of the abrasive to the platen. Alternatively or additionally, the abrasive may be secured to the foam and platen by an adhesive. Haney defines 'secured' as meaning that the motion of the abrasive is completely dependent on the motion of the platen. Thus, when the platen moves the abrasive also moves. The foam is positioned between the platen and the abrasive to provide a soft touch to prevent the grit of the abrasive from scratching into a product too deeply. Without the foam, unwanted scratches would result from products that are not perfectly flat. Haney also discloses clips on both sides of the platen, and a spring-biased rod to operate the clips on the back side of the platen The rod includes a handle and arms. When the handle is pushed down, the rod rotates and the arms contact the clips and cause them to open. The rod can then be locked in place by a locking mechanism. The abrasive is then inserted between the clips and the platen. The clips close when the rod is released. The rod may be secured to a brace.

SUMMARY OF INVENTION

In one embodiment, the invention is a system for rapid replacement of abrasive in machinery having a non-removable platen. In the most preferred embodiment of the invention, one of a set of two rails is on each side of the platen of the apparatus, which rails are movable to increase or decrease the tension on the abrasive material. The abrasive material is frictionally held on each edge to mounts that hold their respective edges within themselves. The mounts are shaped and sized to fit within the rails on each side of the platen. Moving the rails farther apart from each other tightens the abrasive material around the working surface of the platen for normal use, while moving the rails closer together loosens the combination of mounts and abrasive material so that they can be removed as a unit from the apparatus. The edges of the abrasive material may be easily removed from the mounts by releasing the frictional holding element, and the mounts used again with a different piece of abrasive material. In another embodiment, the invention is a mount having means for frictionally holding the abrasive material. In another embodiment, the invention is an abrasive material having integral, permanent mounts on the edges of the abrasive material, so that the entire combination may be supplied or replaced as a unit that fits into the apparatus.

DESCRIPTION OF THE DRAWINGS

The figures are schematic and provided for illustration only, and thus do not limit the scope of the invention.

DETAILED DESCRIPTION

Figure 1:
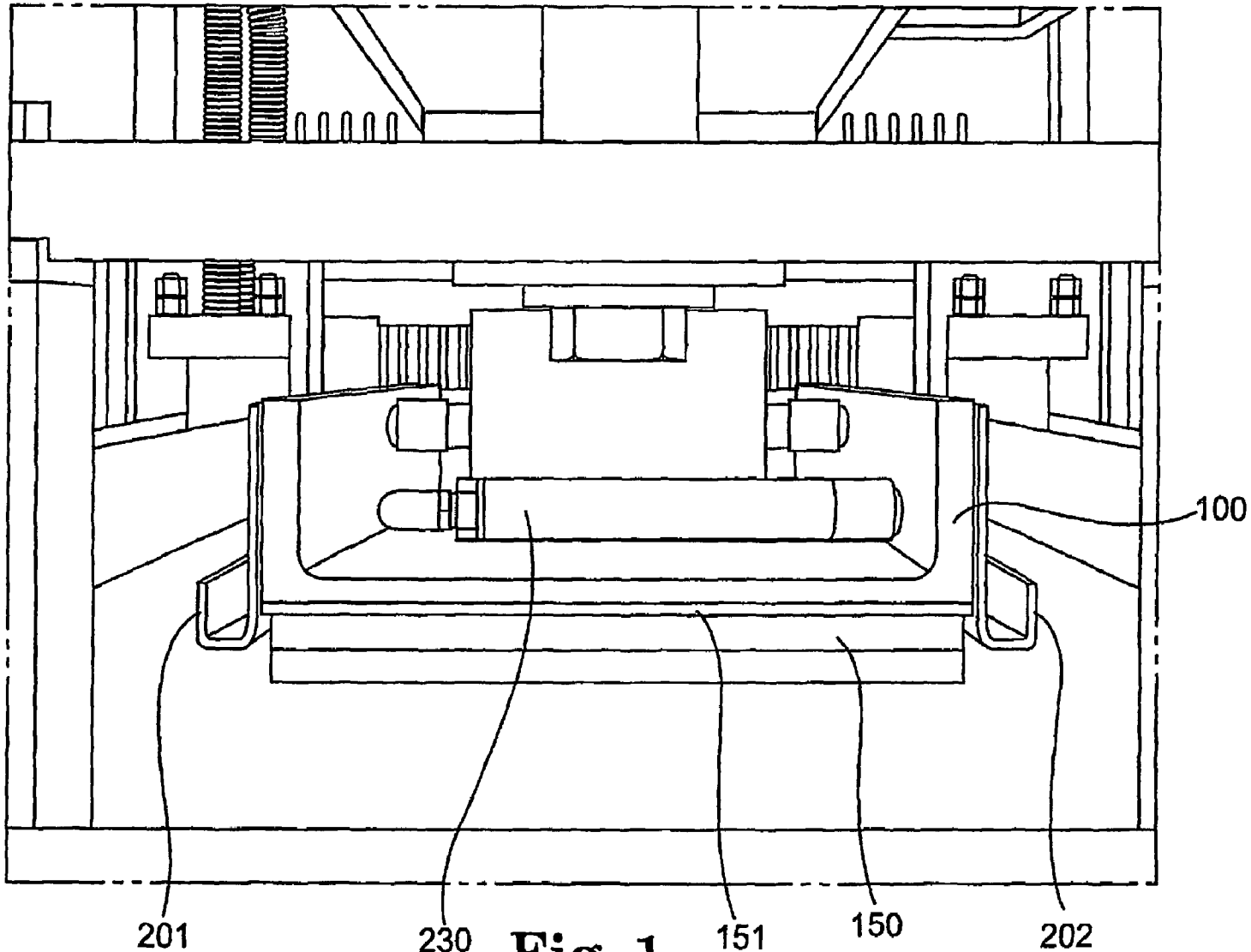
FIG. 1 shows a side view of a portion of a preferred embodiment of the invention, prior to placement of the abrasive material.

FIG. 1 shows that platen 100 of a surface finishing machine is constructed so that pad 150 is somewhat permanently mounted to platen 100 by any convenient means. "Somewhat permanently" refers to the preferred embodiment, in which pad 150 is mounted to a plate 151, which in turn is connected to platen 100 in any conventional manner. Thus, plate 151 may be removed only when it is necessary to replace pad 150, which is not required as frequently as it is may be necessary or desirable to replace the abrasive material, as described below, and platen 100 need not be removed from the apparatus at all (unless that is the most convenient way to replace pad 150 and plate 151).

Platen 100 further comprises rails 201 and 202, at least one of which is moveably and adjustably mounted to the sides of platen 100 so that its longitudinal position with respect to their respective sides of platen 100 may be adjusted by any convenient means. (In this and the other figures, the longitudinal direction is left-to-right or vice versa in the plane of the figure. The workpiece having the surface finished by the machine also moves in the longitudinal direction, i.e., longitudinal corresponds to "forward" or "reverse" directions of the workpiece. The transverse direction is into or out of the plane of the figure, i.e., perpendicular to the longitudinal direction in the plane of the workpiece.) For example, the piston illustrated as 230 moves rail 202 longitudinally away from its respective side of platen 100. In this preferred embodiment, other similar pistons (not shown) behind piston 230 (that is, located transverse to piston 230) similarly move rail 202 longitudinally away from its respective side of platen 100. This is only a preferred embodiment, because the scope of the invention includes any subsystem that places the abrasive material (described below) under increased or decreased tension (i.e., a "means for tensioning the abrasive material" or similar language), preferably by moving either or both of rails 201 and 202 with respect to platen 100 (and thus with respect to each other), but not necessarily in the longitudinally opposed directions indicated in the preferred embodiment of the figure. For example, a system of generally cylindrical members could hold an abrasive material in the same general manner as described below, and then either or both members could be rotated about its axis of rotation to increase or decrease the tension on the abrasive material. (The axis of rotation could be a concentric or an eccentric axis.) Thus, the use of pistons as in the preferred embodiment is only a preference, and even if used, the number of pistons is not a limitation on the scope of the invention.

Figure 2:
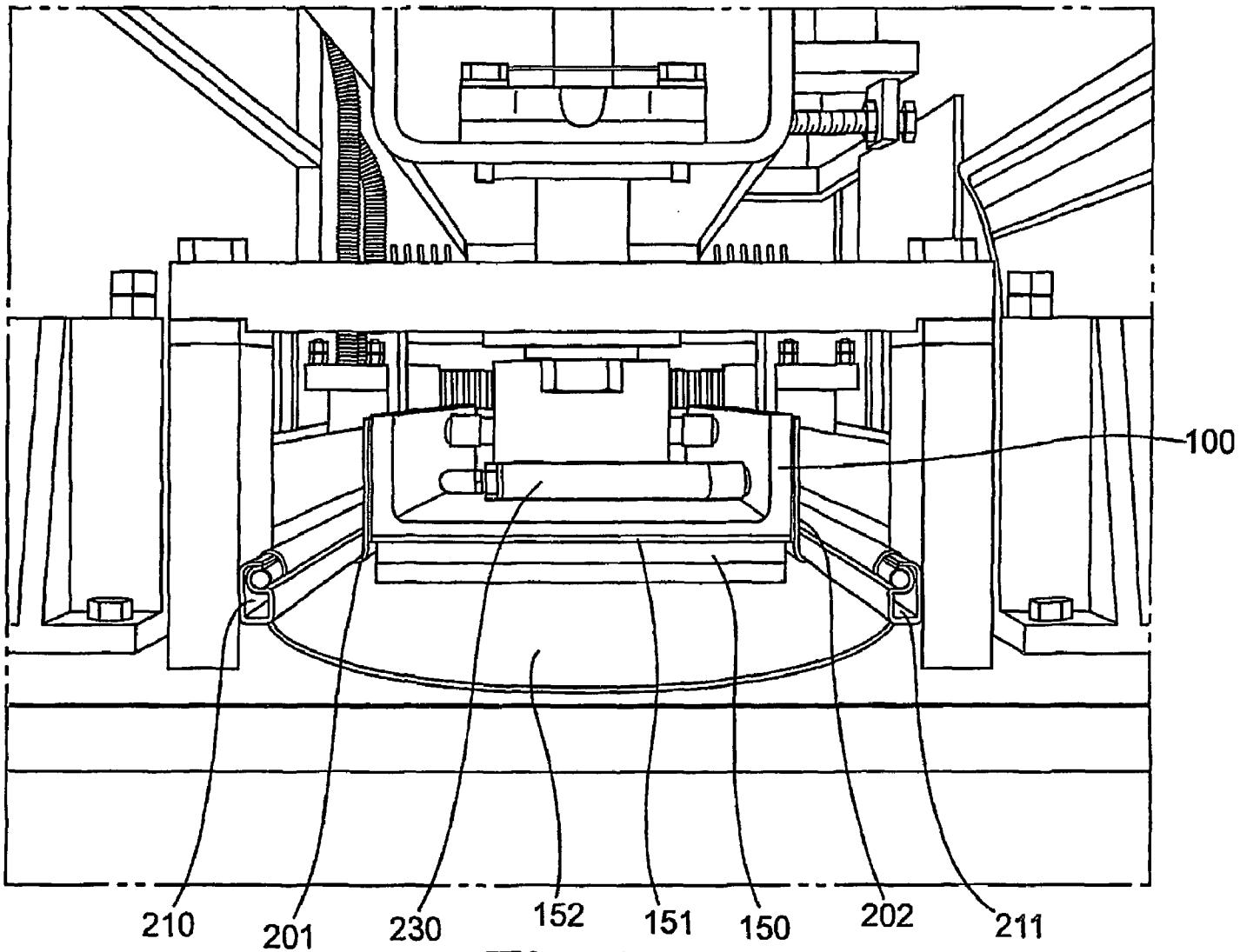
FIG. 2 is similar to FIG. 1 but includes the abrasive material.

FIG. 2 is a view similar to FIG. 1, but also shows abrasive material 152 suspended between its edges. FIG. 2 shows the invention in a position in which the piston 230 has not been used to increase the distance between rails 201 and 202, and thus abrasive material 152 is not yet drawn into a taut position. For purposes of the illustration only, the combination of mounts 210 and 211 and abrasive material 152 is shown partially slid out of working position, towards the viewer (up out of the plane of the figure), but the majority of the length of each mount still lies in its respective rail.

Figure 3:
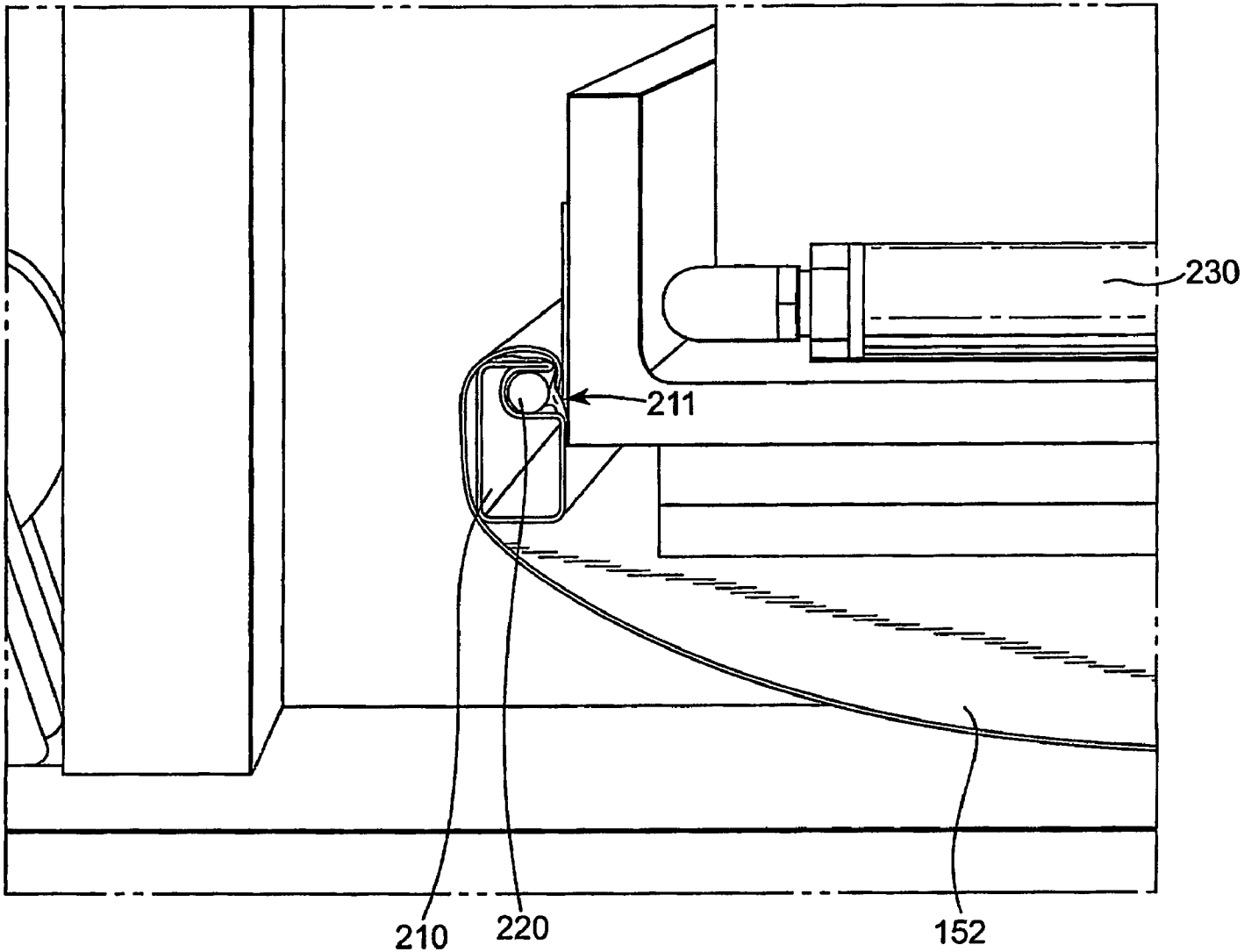
FIG. 3 is a close up view of a portion of FIG. 2, showing a preferred but not required means for frictionally holding the abrasive material in the mount.
Figure 8:
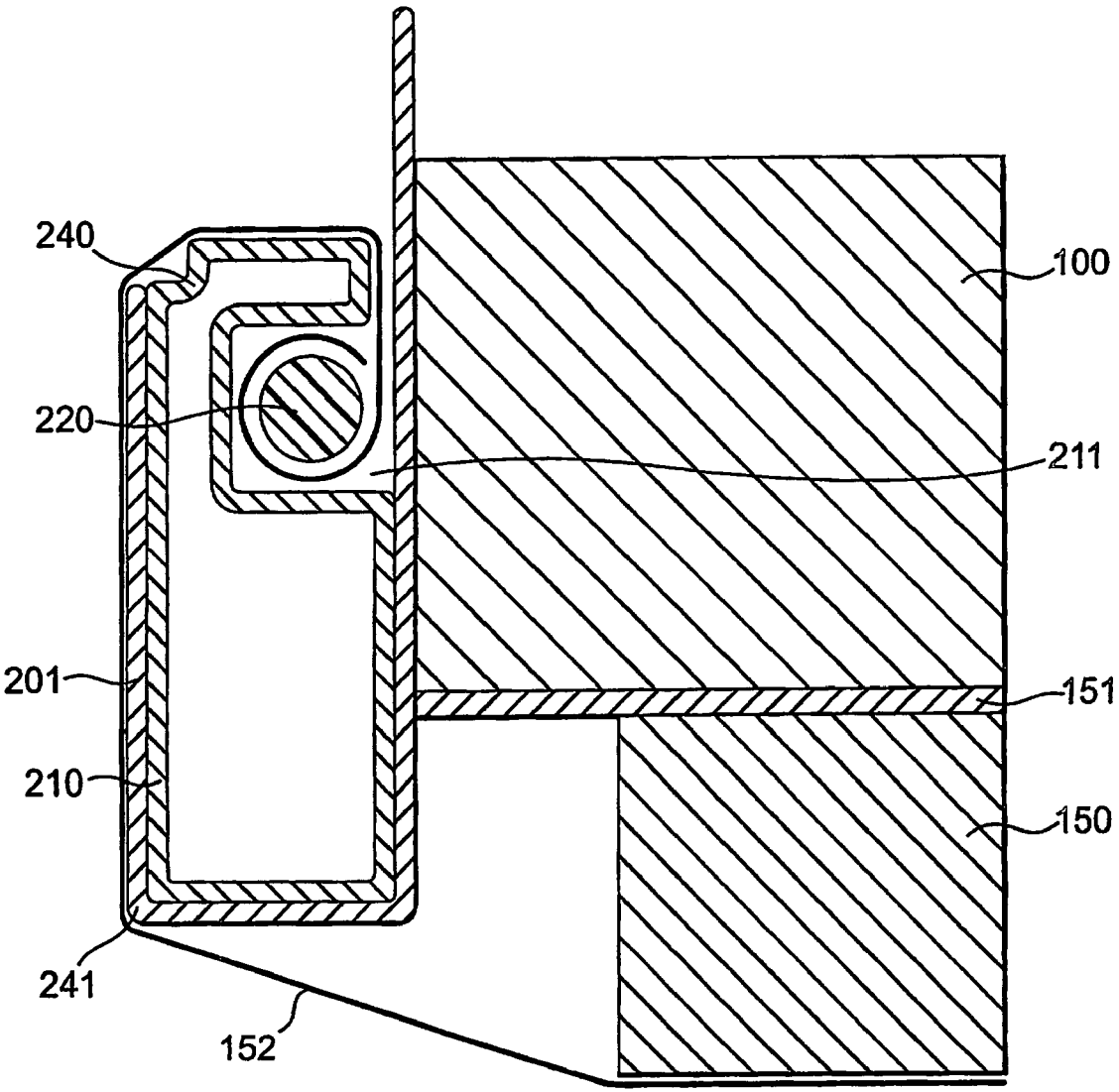

FIG. 3 is a close-up view of mount 210, and FIG. 8 is a schematic view similar to FIG. 3 but having more detail of preferred but not required features. In this preferred embodiment, mount 210 holds the edge of abrasive material 152 in place with a frictional holding element, specifically shown as the preferred spline 220 that is wedged, along with the edge of abrasive material 152, into a channel 211 formed within mount 210, thus frictionally holding abrasive material 152 in mount 210. The size and configuration of both channel 211 and spline 220 are selected so that there is sufficient frictional coupling against the edge of abrasive material 152 to hold that edge in place. In this regard, FIG. 8 schematically indicates the thickness of abrasive material 152, as less than the thickness would be in actual use, for purposes of clarity only. The circular cross-sectional shape of spline 220 is preferred but not required, as elliptical, rectilinear, wedge-shaped, and other spline shapes are within the scope of the invention.

The exact configuration of mount 210 shown in FIGS. 3 and 8 is not a requirement of the invention. Nor are the materials selected for mount 210, which is preferably lightweight extruded aluminum but can be any other material that serves its intended purpose. For example, FIG. 8 shows that features such as indent 240 can be included; this feature is an example of how mount 210 may be shaped to reduce the stress on abrasive material 152 in appropriate locations. (A similar stress reduction feature could be provided at corner 241 of rail 201, if desired.) Spline 220 is preferably a synthetic resilient material but could be a natural material provided that sufficient resilience and strength to perform the functions required by a particular design are provided. The preferred extruded aluminum mount 210 may be formed by a single piece of aluminum stock that is bent to form a hollow frame, the two ends of the material secured to each other by any conventional means.

Figure 7:
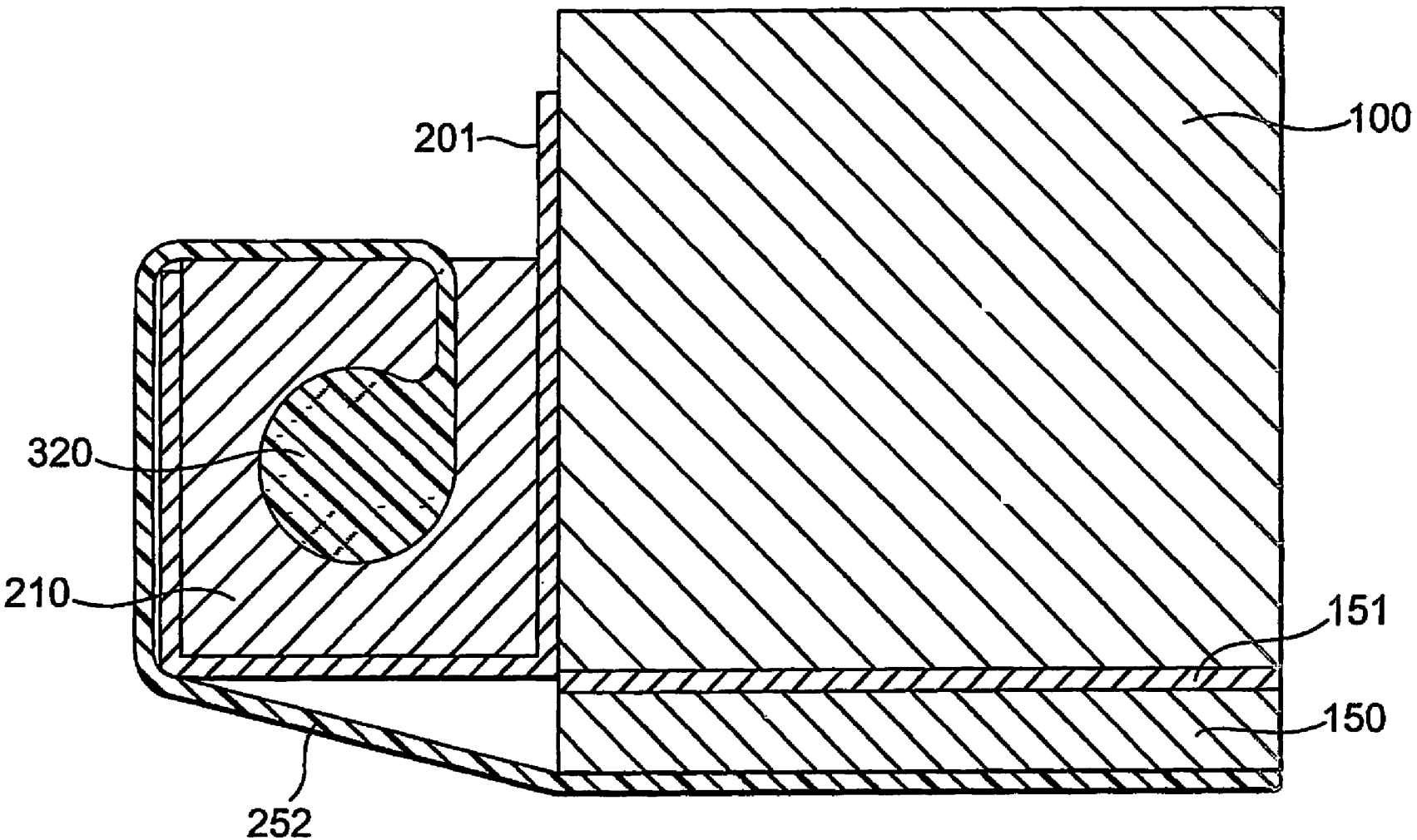

As illustrated schematically in FIG. 7, an alternative embodiment of the abrasive material, denoted as 252, is formed with an integral feature 320 analogous to frictional holding element 220. This provides a single disposable unit that may be rapidly replaced within the surface finishing apparatus according to the principles of the invention.

Figure 4:
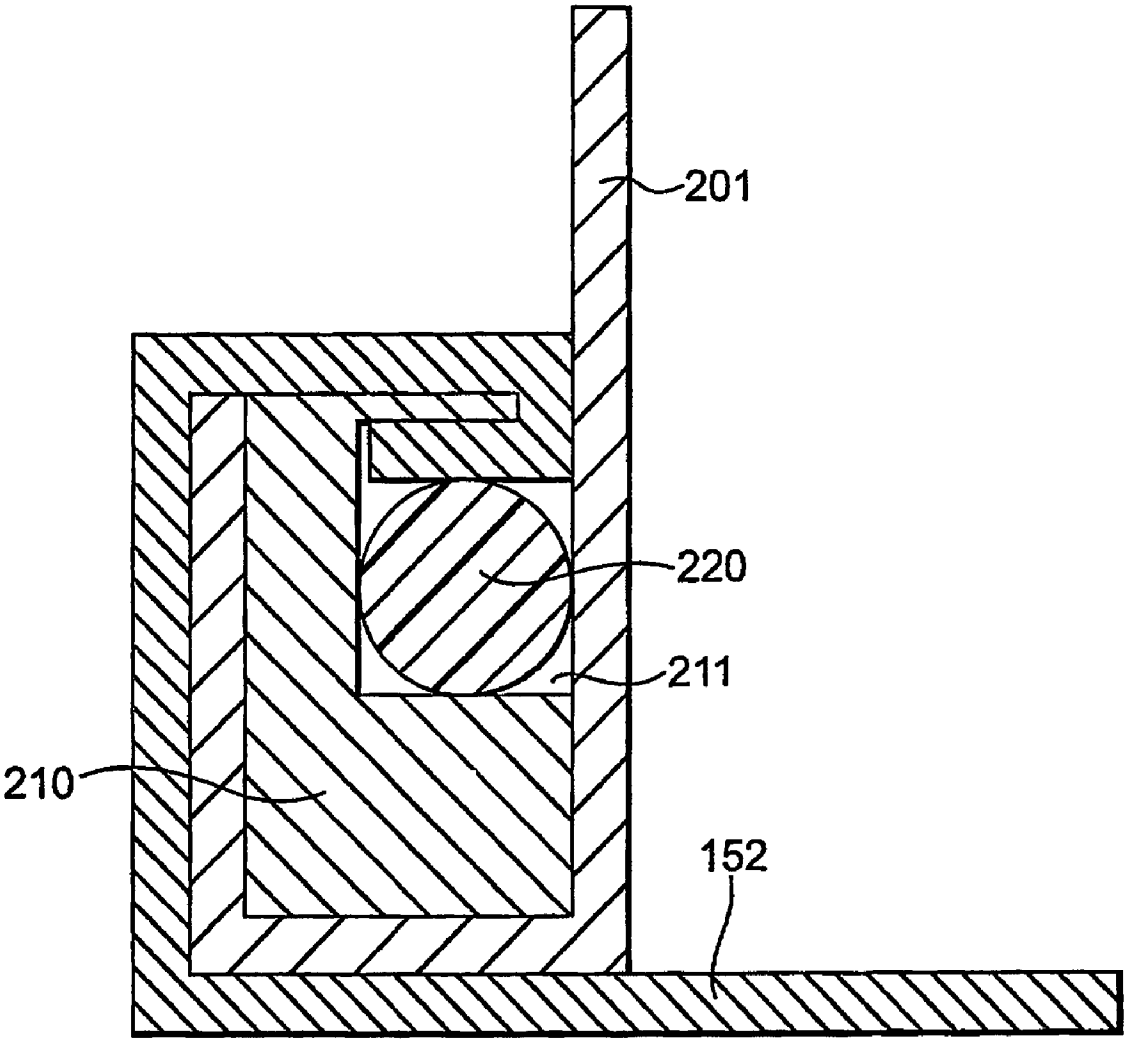
FIG. 4 is a schematic view similar to FIG. 3.
Figure 5:
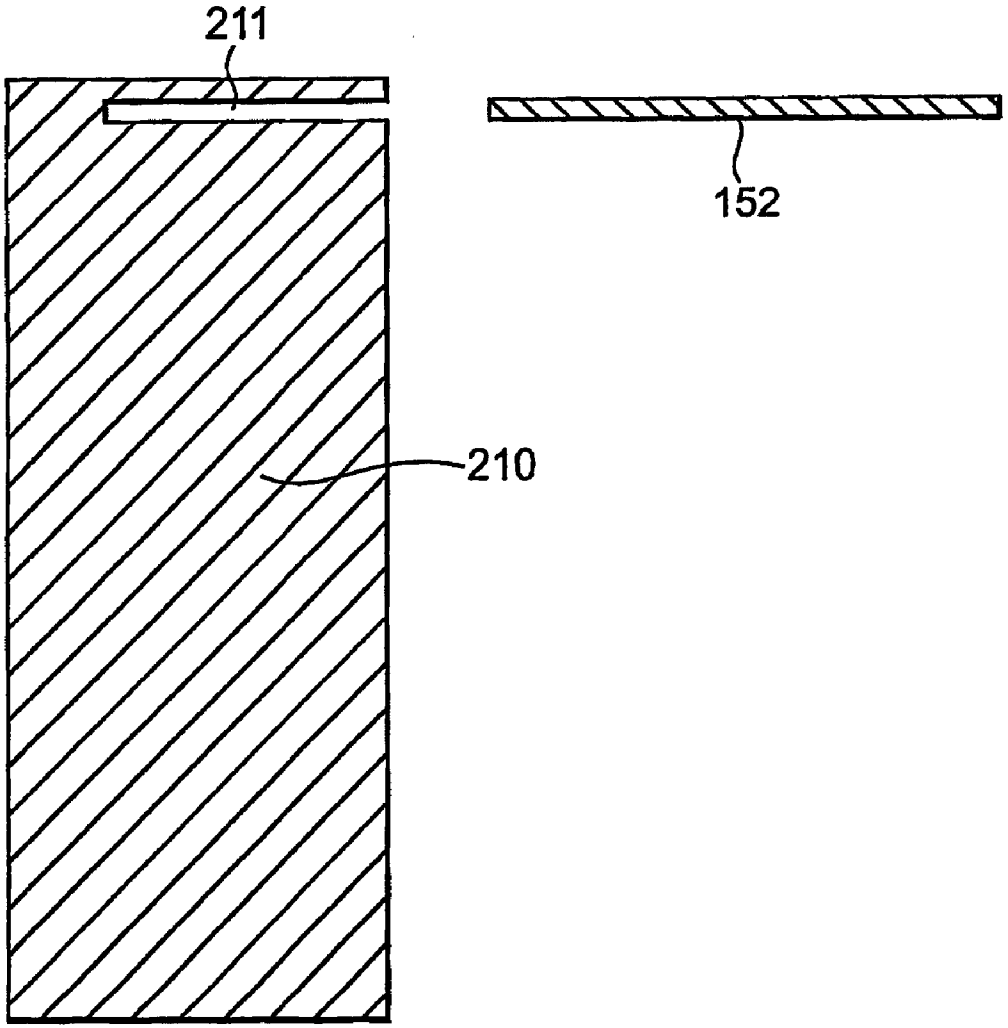
FIGS. 5-8 are schematic views illustrating alternative embodiments to that shown in FIGS. 2, 3 and 4.
Figure 6:
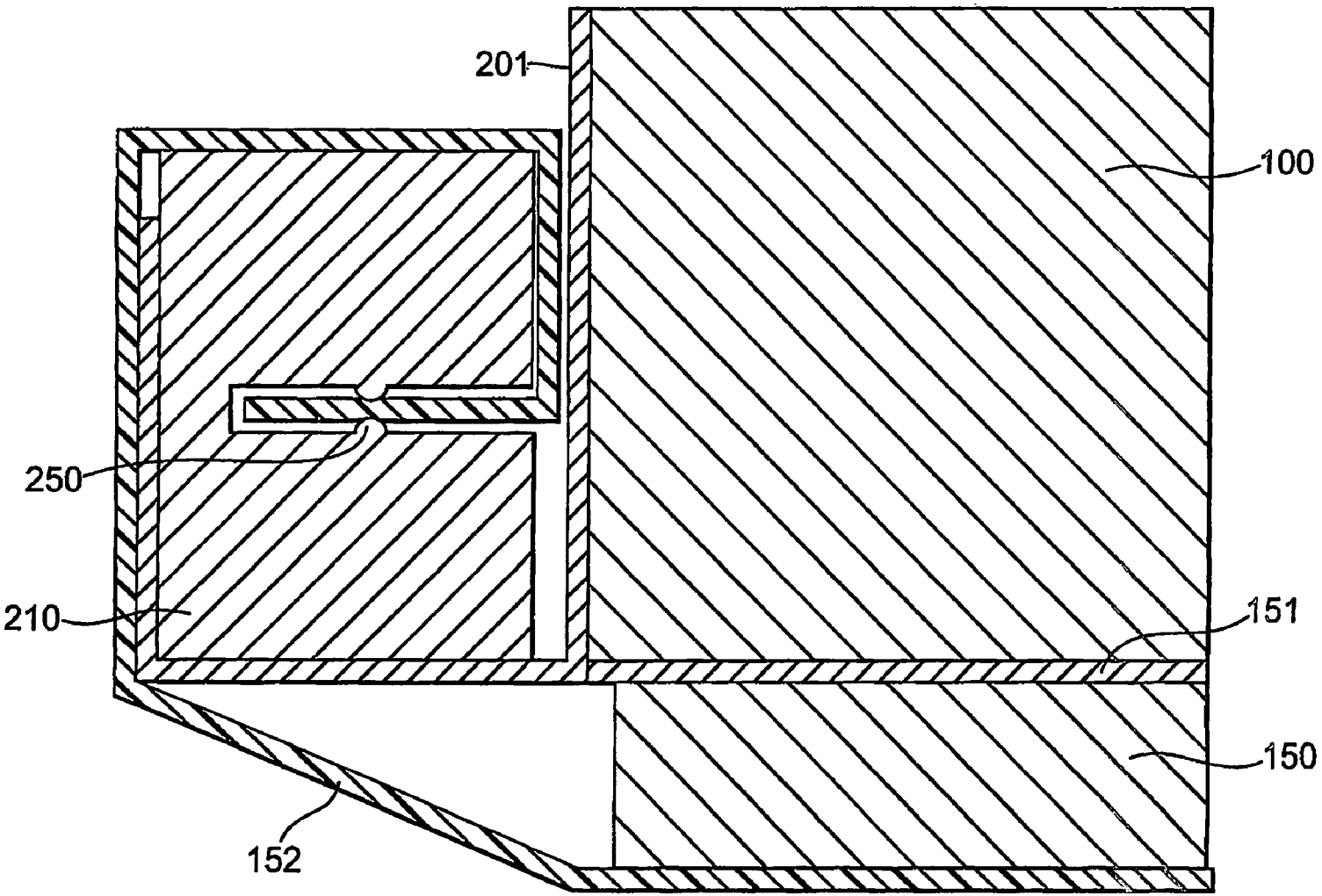

FIG. 4 illustrates schematically the general conceptual arrangement of mount 210, spline 220, abrasive material 152, and rail 201, to emphasize that specific features illustrated in the previous figures are not necessarily requirements of the invention. In this regard, FIG. 5 shows an alternative embodiment, one that illustrates the more general nature of the invention. In general, all that is required is that the edge of the abrasive material 152 be frictionally secured to mount 210 (when a non-integral mount is employed). Channel 211 is shown within the uppermost portion of mount 210 but this is not a requirement of the invention. Frictionally securing abrasive material 152 to mount 210 may not require an inserted frictional holding element 220 if the configuration and materials of mount 210 and/or channel 211 are properly designed. For example, an integral frictional holding element such as a crimp is within the scope of the invention, as illustrated in FIG. 6 (which is also schematic and should not be taken as a limitation on the scope of the invention). The crimp 250 schematically represents any feature that extends from a base to grip the abrasive material by compression on at least one surface of the abrasive material. One or more individual or paired crimps 250 may be employed.

The use of a generally rectangular (in cross-section) mount 210 permits abrasive material 152 to be wrapped around mount 210 without subjecting abrasive material 152 to extreme shear and other tearing forces near the edge of abrasive material 152. Preferred abrasive materials include the so-called "J weight" cloth backed materials, as they are more flexible than "X weight" materials commonly used in the industry. However, other cross-sectional shapes of mount 210 are within the scope of the invention. For example, a generally circular or oval cross-sectional shape could be employed, and a variety of crimp-type features used to hold the edge of the abrasive material in place. The selected shape may also dictate the cross-sectional configuration, size, or other features of rail 201.

In any embodiment of the invention, the abrasive material need not necessarily have constant grit rating throughout its extent. It is possible to have a dual-value (or, in general, a plurality of values) of grit rating, including a continuously variable grit value, as one considers various locations along the extent of abrasive material 152. For example, as the workpiece moves through the apparatus, it could encounter a course grit first, followed by one or more finer grits before leaving the apparatus. This could be accomplished by varying the grit of the material actually attached to abrasive material 152, or it could be accomplished by assembling abrasive material 152 from two or more pieces of material having different grits, such as by using pressure sensitive or other adhesive to splice or otherwise assemble the pieces together.

The prior art approaches disclosed in the patents above use two separate motors to impart two distinct motions to the platen. In the preferred embodiment, the invention employs a single motor to provide the two distinct motions to the platen.

In cross-sectional view, the mounting of abrasive material 152 appears similar to that shown in U.S. Pat. No. 6,001,004 (Botteghi), assigned on SCM Group, S.p.A. of Rimini, Italy. However, that patent uses a continuous supply of abrasive fed from rollers in a direction transverse to the direction that the workpiece travels. The edges of the abrasive material are not supported in a mount and rail system as described above.

I claim:

1. A system for rapid replacement of an abrasive material having two opposed edges in a surface finishing machine having a non-removable platen, comprising:

two rails, one on each longitudinal side of the platen, at least one of which is movable with respect to the platen;

the abrasive material being held between two removable mounts by a frictional element on each of its two opposed edges;

the mounts being shaped and sized to removably fit within the movable rails on each side of the platen, at least one mount comprising a channel within which at least one edge of the abrasive material is held by a frictional element in the form of a spline.

2. The system of claim 1, in which at least one of the two movable rails moves between a first position in which the abrasive material is tightened around a working surface of the platen, and a second position in which the abrasive material is loosened and the mounts and abrasive material are removable from the surface finishing machine.

3. The system of claim 1, in which the movable rail is movable longitudinally away from the platen.

4. The system of claim 1, in which the movable rail is rotatable about its axis.

5. The system of claim 1, in which only one of the two rails is movable with respect to the platen.

6. The system of claim 1, in which both of the two movable rails are movable with respect to the platen.

7. The system of claim 1, in which at least one edge of the abrasive material may be removed from its respective mount by removing its respective frictional element.

8. The system of claim 1, in which the spline has a cross-section that is one of circular, elliptical, rectilinear, and wedge-shaped.

9. The system of claim 1, in which the spline comprises a synthetic resilient material.

10. The system of claim 1, in which any mount comprises extruded aluminum.

11. The system of claim 1, in which any mount comprises a hollow frame.

12. The system of claim 1, in which the frictional element is integrated into the abrasive material.

13. The system of claim 1, in which the mount comprises at least one feature that extends from a base to grip the abrasive material by compression on at least one surface of the abrasive material.

14. The system of claim 1, in which the mount has a cross-section that is one of rectangular, circular, or oval.

15. The system of claim 1, in which the abrasive material has a constant grit rating throughout its extent.

16. The system of claim 1, in which the abrasive material has a plurality of values of grit rating.

17. The system of claim 1, in which the abrasive material has two values of grit rating.

18. The system of claim 1, in which the abrasive material has a continuously variable value of grit rating.

19. The system of claim 1, in which the abrasive material comprises a plurality of pieces of material having differing values of grit rating.

20. A method of enabling rapid replacement of an abrasive material having longitudinally opposed edges in a surface finishing machine having a non-removable platen, comprising:

providing the platen with a set of movable rails, one on each longitudinal side of the platen;

frictionally holding the abrasive material by each of its longitudinally opposed edges in respective mounts, the mounts being shaped and sized to fit within respective rails, at least one mount comprising a channel within which at least one edge of the abrasive material is held by a frictional element in the form of a spline; and controlling tension of the abrasive material around a working surface of the platen during normal use of the machine to enable the abrasive material to be removed from the machine.

21. The method of claim 20, further comprising moving at least one of the two movable rails from a first position in which the abrasive material was tightened around a working surface of the platen, to a second position in which the abrasive material is loosened, and further comprising removing the mounts and abrasive material from the surface finishing machine.

22. The method of claim 20, in which the tension reduction comprises moving the movable rail longitudinally away from the platen.

23. The method of claim 20, in which the tension reduction comprises rotating the movable rail about its axis.

24. The method of claim 20, further comprising removing at least one edge of the abrasive material from its respective mount after removing its respective frictional element.

25. A combination of an abrasive material and a removable mount that frictionally secures a respective edge of the abrasive material within the mount, in which the mount is shaped and sized to fit within a rail located on one side of a non-removable platen of a surface finishing machine, and the mount comprises a channel within which at least one edge of the abrasive material is held by a frictional element in the form of a spline.

26. The combination of claim 25, further comprising a frictional element, and in which at least the edge of the abrasive material may be removed from its mount by removing the frictional element.

27. The combination of claim 26, in which the frictional element is integrated into the abrasive material.

28. The combination of claim 25, in which the spline has a cross-section that is one of circular, elliptical, rectilinear, and wedge-shaped.

29. The combination of claim 25, in which the spline comprises a synthetic resilient material.

30. The combination of claim 25, in which the mount comprises extruded aluminum.

31. The combination of claim 25, in which the mount comprises a hollow frame.

32. The combination of claim 25, in which the mount comprises at least one feature that extends from a base to grip the abrasive material by compression on at least one surface of the abrasive material.

33. The combination of claim 25, in which the mount has a cross-section that is one of rectangular, circular, or oval.

34. The combination of claim 25, in which the abrasive material has a constant grit rating throughout its extent.

35. The combination of claim 25, in which the abrasive material has a plurality of values of grit rating.

36. The combination of claim 25, in which the abrasive material has two values of grit rating.

37. The combination of claim 25, in which the abrasive material has a continuously variable value of grit rating.

38. The combination of claim 25, in which the abrasive material comprises a plurality of pieces of material having differing values of grit rating.

39. A system for rapid replacement of an abrasive material having two opposed edges in a surface finishing machine having a non-removable platen, comprising:

two rails, one on each longitudinal side of the platen, at least one of which is movable with respect to the platen;

the abrasive material being held between two removable mounts by a frictional element on each of its two opposed edges;

the mounts being shaped and sized to removably fit within the movable rails on each side of the platen;

at least one movable rail being movable longitudinally away from the platen.

40. A system for rapid replacement of an abrasive material having two opposed edges in a surface finishing machine having a non-removable platen, comprising:

two rails, one on each longitudinal side of the platen, at least one of which is movable with respect to the platen;

the abrasive material being held between two removable mounts by a frictional element on each of its two opposed edges;

the mounts being shaped and sized to removably fit within the movable rails on each side of the platen;

at least one mount comprising at least one feature that extends from a base to grip the abrasive material by compression on at least one surface of the abrasive material.

41. A combination of an abrasive material and a removable mount that frictionally secures a respective edge of the abrasive material within the mount, in which the mount is shaped and sized to fit within a rail located on one side of a non-removable platen of a surface finishing machine, and the mount comprises at least one feature that extends from a base to grip the abrasive material by compression on at least one surface of the abrasive material.

42. A combination of an abrasive material and a removable mount that frictionally secures a respective edge of the abrasive material within the mount, in which the mount is shaped and sized to fit within a rail located on one side of a non-removable platen of a surface finishing machine, and the abrasive material has a plurality of values of grit rating.

* * * * *